United States Patent [19]

Kennedy

[11] Patent Number: 4,753,137

[45] Date of Patent: Jun. 28, 1988

[54] HAND TOOL, SUCH AS A SLEDGEHAMMER, WITH REPLACEABLE HEAD

[76] Inventor: Thomas W. Kennedy, 575 Willow St., West Barnstable, Mass. 02668

[21] Appl. No.: 33,590

[22] Filed: Apr. 1, 1987

[51] Int. Cl.[4] ..... B25G 3/12

[52] U.S. Cl. ..... 81/22; 81/25; 81/20

[58] Field of Search ..... 81/22, 25, 20, 489

[56] References Cited

U.S. PATENT DOCUMENTS 2,702,060 2/1955 Bonnesen ..... 81/22

3,704,734 12/1972 Soto et al. ..... 81/22

*Primary Examiner*—Frederick R. Schmidt

*Assistant Examiner*—Blynn Shideler

*Attorney, Agent, or Firm*—Richard P. Crowley

[57] ABSTRACT

A hand tool, such as striking device like a sledgehammer, having replaceable head elements, which device comprises a handle having a raised extension on one end and a threaded cavity therein, and a replaceable head element, having a cavity therein; an insert having a hole therein to fit into the top part of the cavity of the head element, a threaded bolt, an a retaining tubular, elastomeric element, subject to expansion on axial compression, whereby various head elements of different cavity size may be secured to the extension of the handle by placing the threaded bolt through the insert hole and through tubular retaining element and threading the bolt into a threaded cavity of the raised extension to axially compress and expand outwardly the tubular elastomeric element into a frictional and shock-absorbing relationship with the interior surface of the head element cavity, thereby providing a hand tool device by which head elements having various cavity dimensions may be rapidly and efficiently secured to the handle.

11 Claims, 1 Drawing Sheet

HAND TOOL, SUCH AS A SLEDGEHAMMER, WITH REPLACEABLE HEAD

BACKGROUND OF THE INVENTION

Striking devices, such as mauls, sledgehammers, axes, tire irons and the like, typically employ a striking-type head element secured to a handle. In various striking-type devices employed, damage may occur to the handle or the head element. In time, the device must normally be replaced or the head element changed to perform a different function. It is therefore desirable to provide for a device wherein a variety of head elements may be easily and quickly replaced on the handle, particularly where the head elements vary somewhat in size, weight, shape and interior cavity dimensions.

SUMMARY OF THE INVENTION

The invention relates to a hand tool device with a replaceable head and to the method and use of the device. In particular, the invention concerns a striking-type device, such as a sledgehammer or other heavy, head-type devices, where it is desirable to provide for the replacement of the head.

A hand tool device, particularly a striking device, such as a sledgehammer and the like, has been discovered which provides for easily replaceable heads on a rigid, shock-absorbing handle. In the use of such striking devices, damage to the handle often occurs, and also it is desirable to provide a striking device wherein a strong, shock-absorbing handle is provided together with a replaceable head means wherein various head elements may be easily, rapidly and efficiently replaced on a single handle. One of the problems associated with replaceable head elements is that the head elements typically vary in the dimensions and shape of the cavities employed therein since the heads are designed for use with specific and other different handle ends. Therefore, it is desirable to provide a device wherein various head elements may be replaced even though the cavity in the head elements may not exactly fit the end of the single handle, and also to provide a strong, shock-absorbing handle so that a single handle unit may be employed with a variety of replaceable head elements.

The device of the invention comprises an enlongated handle and a head element, secured at the one end of the handle in a secure and replaceable manner, the handle having a raised extension thereon with a threaded interior, and with the head element having a cavity therein and extending therethrough. A head insert having an opening is inserted in the top of the head cavity, a threaded means, such as a threaded bolt is inserted into the opening of the head insert and into a threadable relationship to the threaded interior of the extension of the handle. A retention means of tubular, resilient, expandable material is used to retain the head means in a secure, shock-absorbing relationship at the end of the handle.

The retention means comprises an elastomeric tubular element having a one and the other end and which is axially positioned in the said cavity of the head and placed between the one end of the head insert and the top surface of the extension element. The retention means is composed of a material which when subject to axial compression by the tightening of the threaded bolt into the threaded interior, the retention means expands outwardly into a gripping, shock-absorbing, contacting relationship with the interior wall surface of the cavity of the head element. This provides a frictionlly, engaging technique which permits the use of head elements with various sized cavities to be employed and to be retained at the end of the handle, and also provides for improved shock-absorbing where the head element is a striking-type head element.

The retention means is typically composed of a tubular, polymeric or elastomeric-type polymer having an interior opening sufficiently large to permit the threaded bolt to pass therethrough. The thickness of the tubular element should be sufficient to impart strength to the element and to permit one end to rest on the top surface of the extension element and the other end on the bottom surface of the head insert or a locking washer so that the tubular ends may be axially compressed when the threaded bolt is tightened into the insert. The length of the tubular retention element may vary, but should be sufficiently long, for example, one-half to three inches, and more particularly, one to two inches, so on axial compression to bow and expand outwardly in the cavity of the head element. The thickness of the tubular element may vary, particularly for example one-eighth to one-half inches, more particularly about one-quarter of an inch. Generally, the tubular retention element may be composed of an elastomeric or polymeric materials, such as elastomeric rubbers or polymers, particularly a urethane, neoprene rubber, butyl rubber, ethylene-propylene rubber or similar type elastomeric material. For example, the elastomeric material may have a Shore hardness of about 60D to 75D and be composed of an EPDM rubber.

The retention means prevents the head from becoming loose on the handle, takes up the extra space in heads of large cavities, helps to secure the head by the being axial outwardly compressed into the interior walls of the head cavity and in reducing shock through the head to the handle and importantly permits heads with varying size cavities to be used.

The device includes a handle, preferably a metal handle having a thick coating of elastomeric material at least at one end and extending toward the other end of the handle in substantial amounts and length to provide for a shock-absorbing, gripping section of the handle.

The head elements in present use and supply generally comprise a cavity therein and into which a handle end is inserted and secured, which cavity generally is an ellipsoidal-type cavity, which extends therethrough and which may be tapered to fit the end of a particular handle. In the device, the one end of the handle contains a raised extension element over which the cavity of the head element fits and which extension element is generally elliptical in shape to fit generally the head cavity.

The invention will be described for the purposes of illustration only in connection with certain embodiments, however, is it recognized that persons skilled in the art may make various changes, additions, modifications and improvements to the illustrated embodiment, all falling within the spirit and scope of the invention.

DESCRIPTION OF THE EMBODIMENTS

Figure 1:
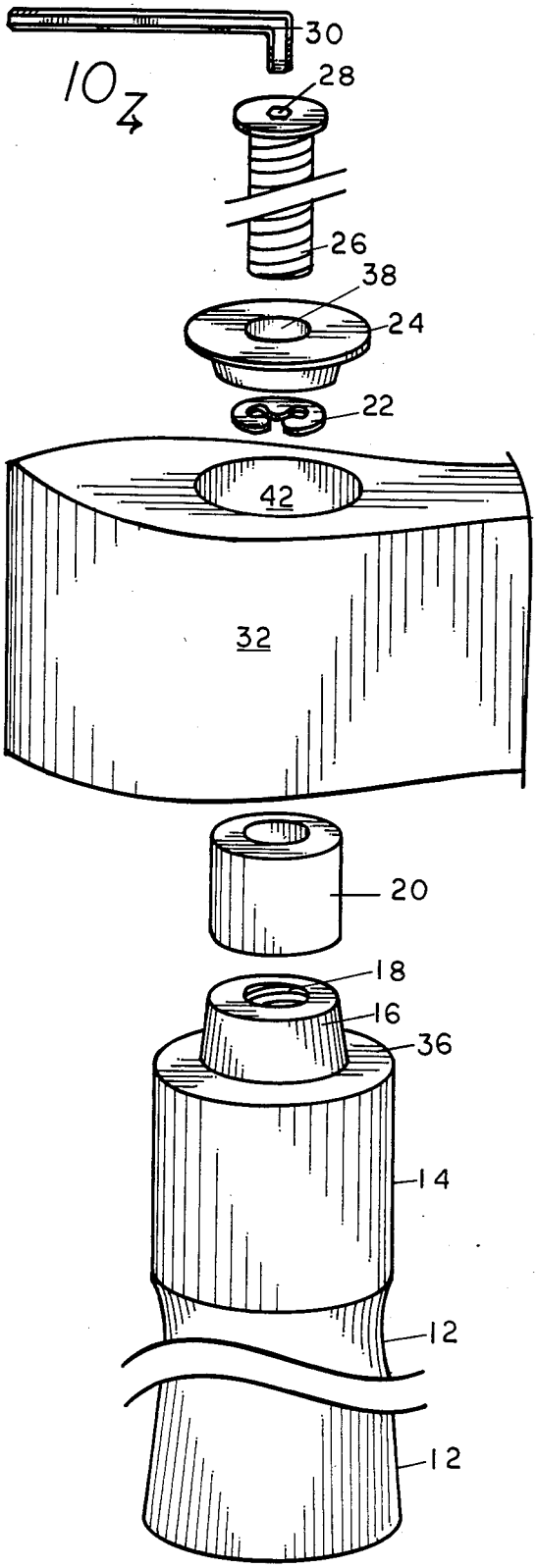
FIG. 1 is a schematic, illustrated, exploded view of an unassembled sledgehammer of the invention.
Figure 2:
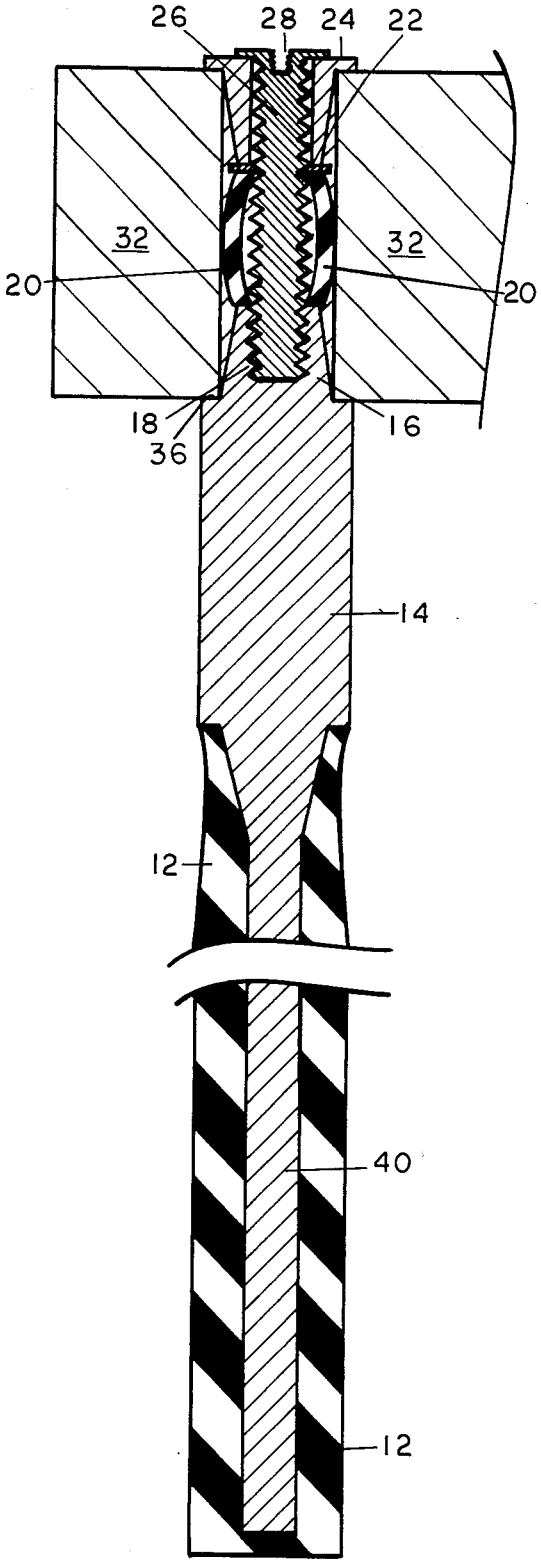
FIG. 2 is an illustrative sectional view of the sledgehammer of FIG. 1 in an assembled position.

With references to the figures, FIGS. 1 and 2 show a striking device 10, such as a sledgehammer, which includes an elongated steel handle having an ellipsoidally-shaped head 14 and including an elongated shank 40 covered with a bonded, thick layer of an elastomeric, shock-absorbing, resilient polymer 12 to provide for a generally ellipsoidally-shaped hand-gripping handle. The thickness of the polymer may vary as desired, and typically is about 30% to 70% of the handle thickness, such as from one-quarter to one-half inch. The head 14 and the shank 40 should normally be composed of steel or other substantially non-breakable material, and the polymer directly bonded to the outer surface of the handle.

The handle includes an ellipsoidally-shaped, raised extension 16 composed of a truncated, conical element with the major axis aligned with the major axis of the ellipsoidal handle, and inset from the end of the handle by a shoulder 36, and which raised extension includes a threaded interior 18. The head comprises a sledgehammer head 32 and includes a cavity 42 extending therethrough, typically an ellipsoidal-shaped cavity. The head elements employed on the handle may vary in size, weight, shape and purpose, and generally have ellipsoidal cavities that vary in size. The striking device 10 provides for a means by which replaceable head elements may be used of varying head cavity dimensions.

The striking device 10 also includes a tubular, resilient retention element composed of elastomeric, polymeric material 20 having a one and the other end and subject to, on axial compression, to move outwardly and bow and fill the head cavity space or engage into a frictional contact with the inner surface of the cavity of the head element 32. As illustrated more particularly in FIG. 2 wherein the retention element 20 is shown in a compressed, bowed state, the resilient element should be of sufficient length to become bowed and of sufficient thickness so that in its bowed condition, it contacts the interior cavity walls of the head element 32. The tubular, resilient element 20 therefore provides for use of heads 32 of various size and shape head cavities to be secured and also aids in reducing shock transmission to the handle.

The striking device 10 also includes a head insert element 24 having a central hole 38. The insert element 24 typically may be ellipsoidally-shaped, and of sufficient size at the one end to be inserted in the head cavity 42 while the other end is sufficiently wide to extend fully across the top end of the head cavity 42. The striking device 10 includes a threaded bolt 26 with a polygonal cavity 28 so that the threaded bolt 26 may be tightened through the use of an Allen-type wrench 30, although it is recognized that the threaded bolt 26 may also be composed of a bolt having a head which may be turned for tightening and loosening by a wrench. Optionally, a lock washer 22 may be employed to prevent loosening of the bolt 26.

As illustrated more particularly in the assembled condition in FIG. 2, the sledgehammer head 32 is secured by passing the bolt 26 through the hole 38 in the insert 24, and the insert inserted in the cavity 42, the bolt passing through the interior of the resilient, tubular element 20 and threaded into the threaded interior 18 of the extension 16 and tightened by wrench 30. The one end of the retention element 20 rests on the extension surface, and the other end rests against the secured bottom surface of the lock washer 22 to provide flat, solid surfaces for axial compression. As illustrated in FIG. 2, the tightening of the bolt 26 causes the outward or bowed movement of the tubular, resilient element 20 to contact with the walls of the head cavity 32.

As illustrated, the striking device 10 provides for the easy and rapid replacement of the head element by merely tightening the bolt and inserting a new head, which head element may vary in its cavity dimensions, but which head element can be secured through the use of tubular retention element 20. Thus, a variety of heads may be used with a single handle 14. Therefore, as illustrated, a hand tool, such as a sledgehammer, is provided with a replaceable head. In practice, a sledgehammer kit may be provided with a single handle and a plurality of replaceable head elements of different types, shapes and weights.

What is claimed is:

1. A hand-held device, such as a sledgehammer, having a replaceable head, which device comprises in combination:

(a) a handle having the one and the other end, the one end of the handle to provide a gripping surface for use of the device, and the other end to provide for a replaceable head means having various size cavities, said other end having a peripheral inwardly spaced shoulder and a raised non-circular, tapered central extension element thereon adapted to fit into the cavity of various head means, said extension element characterized by a threaded interior;

(b) a replaceable head means to provide a head of defined function on the other end of the handle means, said head means adapted to be secured in a replaceable manner to the other end of the handle, and said head means characterized by a non-circular head cavity therein having straight sides extending between the one bottom and other top axial ends of the head means, the one bottom end of the cavity of the head means adapted to fit over the raised extension element and the head means to sit on the said peripheral shoulder;

(c) a tapered head insert means to hold the head means on the other end of the handle, said head insert means having a one and other end and said head insert means characterized by a non-threaded central opening therein between the one and other end, the one small tapered end of the head insert means adapted to be inserted within the one end of the head cavity and to fit head cavities of various sizes and the other end of said head insert means having a shoulder of sufficient dimensions to extend across the other top end of the head cavity and to rest on the head means about the cavity;

(d) a threaded means adapted to be inserted through the non-threaded central opening of the head insert means and threadedly secured into the threaded interior of the extension element, said threaded means comprises a positive engagement means to engage the said head insert means; and (e) a retention means to retain the head means in a secure, shock-absorbing position on the other end of the handle means, the retention means comprising an elastomeric, tubular element having a one and the other end and of a diameter to be axially positioned in said cavity of the head means and to fit head cavities of various sizes between the insert means and the raised extension element, the one end of the retention means on the raised extension element and the other end of the retention means axially positioned beneath the one small bottom tapered end of the insert means, so that on axial compression of the retention means by the movement of the threaded means to force the insert means downwardly into a head retention position the retention means expands and bows outwardly into a gripping frictional relationship with the interior straight wall surface of the head cavity and secures the head means to the other end of the handle means thereby providing a hand device wherein a head means of varying cavities may be adapted to a single handle.

2. The device of claim 1 wherein said extension element comprises a truncated, ellipsoidal-shaped, raised conical element.

3. The device of claim 1 wherein the handle means comprises an elastomeric covered steel rod.

4. The device of claim 1 wherein the tubular retention means comprise an elastomeric, tubular polymer composed of an elastomeric urethane or rubber polymer.

5. The device of claim 1 wherein the head insert means comprises a truncated, ellipsoidal-shaped, conical insert element.

6. The device of claim 1 wherein the head insert means comprises a truncated, ellipsoidal-shaped, conical element having a shoulder at the one end, which shoulder extends beyond and about the head means at the one end.

7. The device of claim 1 wherein the threaded means comprises a threaded bolt with a head that includes a polygonal cavity in the head to provide for the turning and tightening of the bolt through the employment of a polygonal wrench.

8. The device of claim 1 wherein the head means comprises a maul, sledgehammer, tire iron or axe head element.

9. The device of claim 1 which includes a threaded locking washer, the locking washer positioned on the threaded means between the one end of the insert and the other one end of the tubular retention means.

10. A hand held device kit, which kit comprises the device of claim 1 and a plurality of head means with cavities of various sizes to fit on the other end of the said handle of the device.

11. The device of claim 1 wherein the head cavity comprises a tapered, straight sided, ellipsoidal-shaped head cavity.

* * * * *